United States Patent [19]

DiMarzio

[11] 4,133,243

[45] Jan. 9, 1979

[54] ELECTRIC PICKUP

[76] Inventor: Lawrence P. DiMarzio, 210 Davis Ave., Staten Island, N.Y. 10310

[21] Appl. No.: 823,687

[22] Filed: Aug. 11, 1977

[51] Int. Cl.[2] ..... G10H 3/08

[52] U.S. Cl. ..... 84/1.15; 84/1.16

[58] Field of Search ..... 84/1.01, 1.04, 1.14, 84/1.15, 1.16, 1.24

[56] References Cited

U.S. PATENT DOCUMENTS

| | | | |
|---|---|---|---|
| 2,911,871 | 11/1959 | Schultz | 84/1.15 |
| 3,541,219 | 11/1970 | Abair | 84/1.16 |
| 3,588,311 | 6/1971 | Zoller | 84/1.15 |
| 3,711,619 | 1/1973 | Jones | 84/1.16 |
| 3,715,446 | 2/1973 | Kosinski | 84/1.15 |
| 3,916,751 | 11/1975 | Stich | 84/1.15 |
| 4,026,178 | 5/1977 | Fuller | 84/1.15 |

*Primary Examiner*—B. Dobeck
*Assistant Examiner*—William L. Feeney
*Attorney, Agent, or Firm*—Auslander & Thomas

[57] ABSTRACT

An electric pickup for a lute-type musical instrument such as a guitar, has generally circular axial adjustment openings with internal wrench flats in unhardened steel or iron pole pieces. Two bar-type permanent magnets are disposed with like polarities adjacent and straddling one end of the pole pieces. A keeper of steel or the like bridges the permanent magnets.

10 Claims, 5 Drawing Figures

FIG.1
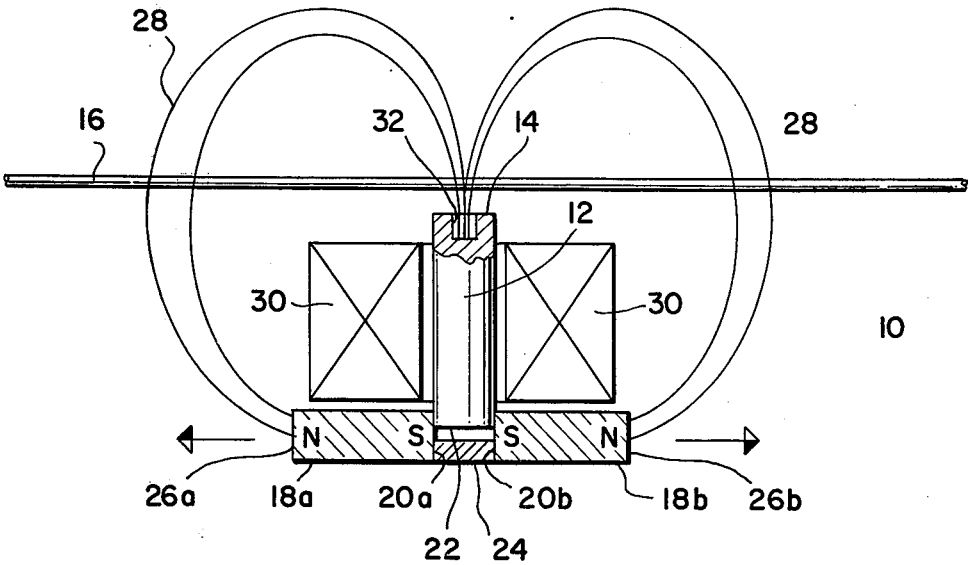
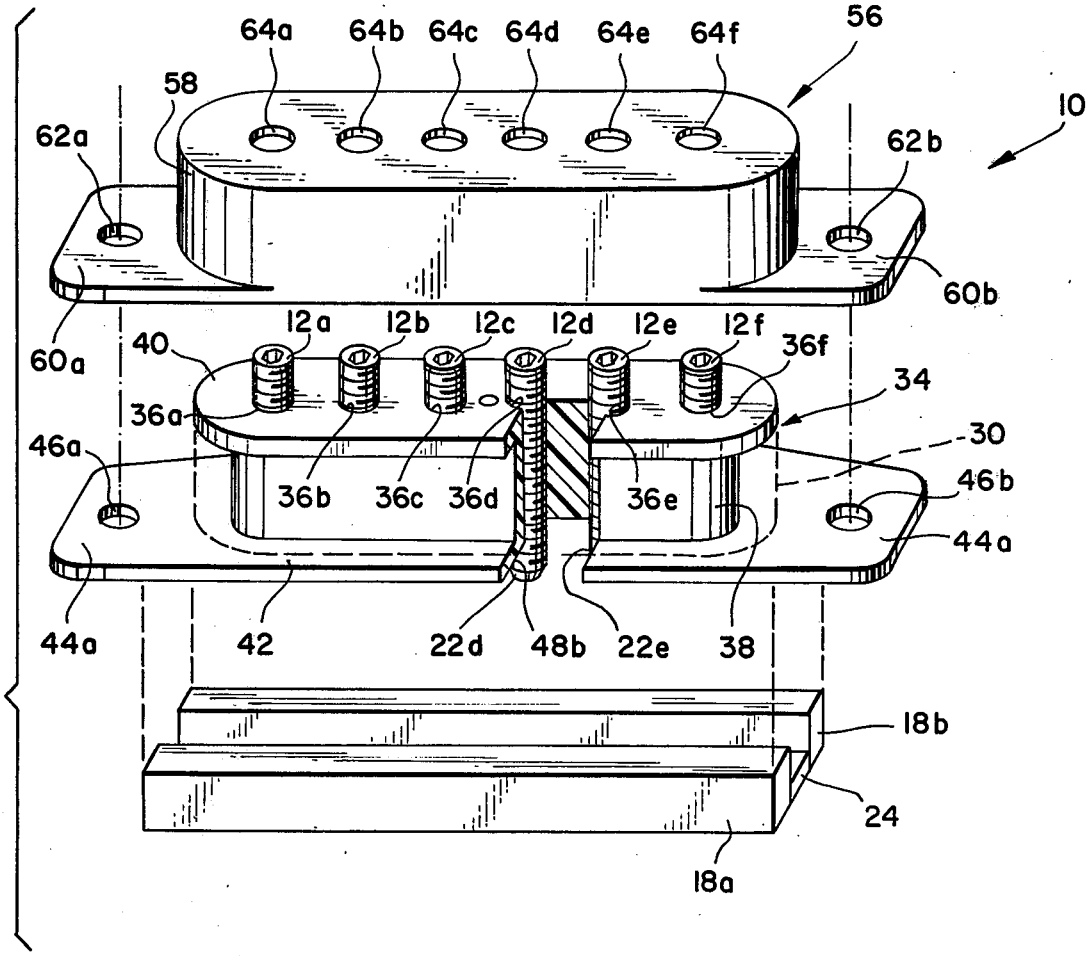
FIG.2

FIG.3
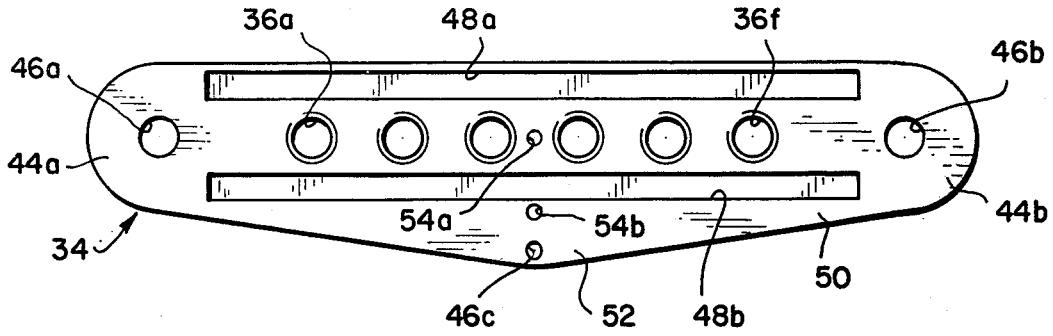
FIG.4
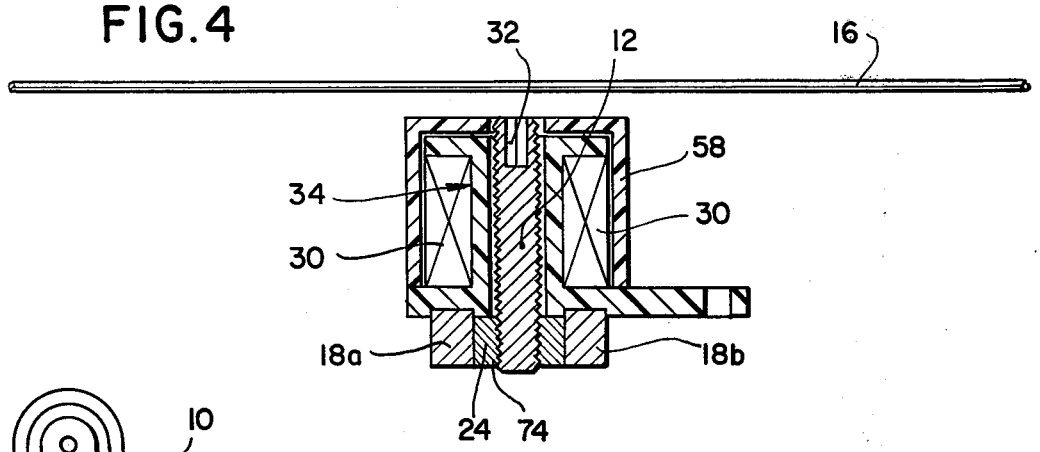
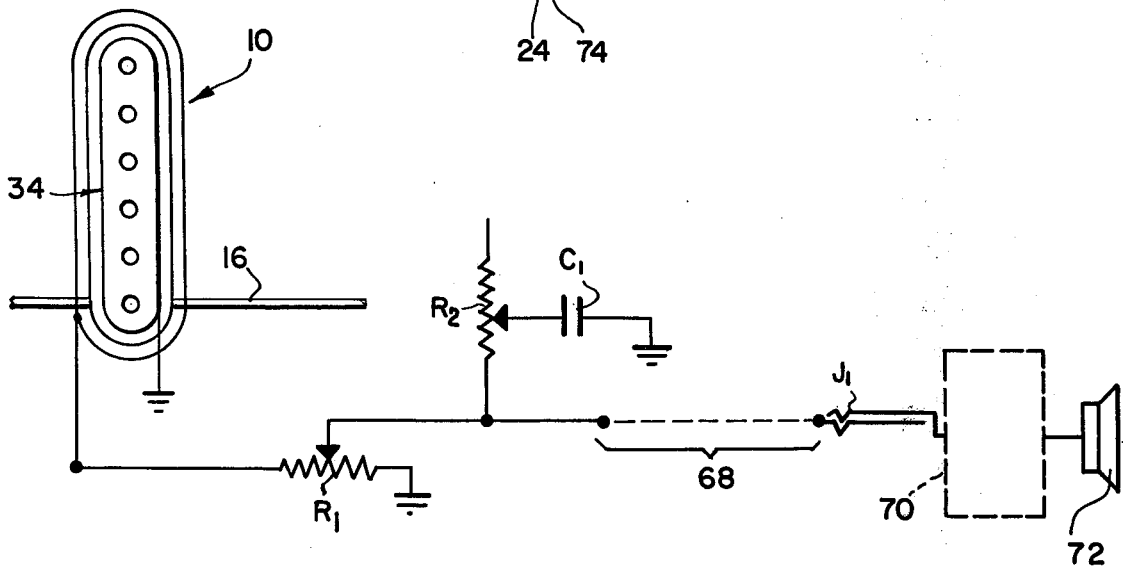
FIG.5

ELECTRIC PICKUP

Electric guitars conventionally employ magnetic pickup devices in the vicinity of their ferrous metal strings to transduce the mechanical string vibrations to electrical signals. U.S. Pat. Nos. 2,976,755, 3,236,930, 3,544,696 and 2,817,261 exemplify guitar pickups in which a plurality of small permanent magnets of alnico or the like are disposed with one pole of each magnet adjacent to a string of the guitar. A coil wrapped about each magnet senses the changing lines of force passing through the magnet when the ferrometallic string vibrates adjacent to one or more of the magnet poles. One of the problems inherent in this arrangement is the undesirable damping of the string vibration due to the nearby presence of the magnetic field. This damping is particularly deleterious at the higher harmonics which many musicians consider vital to give "presence" to the music. In addition, the wound permanent magnets develop such small electric signals that large electronic amplification is required to raise the output of the guitar pickup to the desired room-filling volume. When such large electronic amplification is used, undesired electrical interference, particularly 60 and 120 hz hum, is picked up and amplified. Various hum-bucking arrangements have been tried to eliminate unwanted pickup. Hum-bucking designs are shown in U.S. Pat. Nos. 2,817,261, 2,896,491, 3,544,696 and 2,967,755. In each of these designs, two permanent magnets with windings in opposite directions are disposed adjacent to each string. The polarity of the magnets causes the signal from string motion to be additive while the oppositely wound coils cause electrical pickup from external sources to cancel.

In addition, permanent magnetic materials such as hardened steel of nickel-steel alloys, resist changes in their state of magnetization. This characteristic is called the coercive force of the material. The greater the coercive force of the material, the more difficult it is to change its magnetic state. For example, carbon steel has a coercive force of 52.4 compared to 4.6 for iron (Handbook of Chemistry and Physics, 28th Edition). Thus, carbon steel presents somewhat more than ten times the resistance to varying of its magnetic state than does iron. Furthermore, the measure of permeability of steel is only about one sixth that of iron (ibid). Therefore, much greater magnetic intensity is required for the same flux density in steel as compared to iron. These characteristics account for the small electric signal output from magnetic pickups using permanent magnets.

U.S. Pat. No. 2,896,491 teaches a magnetic hum-bucking pickup which employs two soft-iron pole pieces per string. The pole pieces are magnetized by a single permanent magnet between their ends. This makes the two pole pieces on each string of opposite polarity. Coils about each set of pole pieces are wound in a hum-bucking arrangement.

U.S. Pat. No. 2,911,871 teaches a magnetic pickup having two permanent magnets with like poles abutting a single bar-type soft-iron pole piece into which a plurality of individual pole pieces are threadably engaged. The individual pole pieces are adjustable toward and away from the strings of the instrument using slotted type screw heads. The lines of force through which a vibrating string passes when in the vicinity of a slotted pole piece vary by several percent, depending on whether the slot is aligned with, or normal to the string.

This makes accurate balancing from string to string very difficult. The pickup winding in U.S. Pat. No. 2,911,871 is about the single, relatively massive pole piece. The percentage change in lines of flux due to string vibration in such a massive single pole piece is relatively small. Consequently, the transduced electrical output is relatively small.

The present invention teaches a guitar pickup in which a plurality of unhardened ferrometallic pole pieces are adjustable disposed in a bobbin of nonmetallic material such as plastic. The pole pieces are generally cylindrical with outside threads which threadably engage the insides of parallel bores in the plastic bobbin. The pole pieces are provided with adjustment means at their ends nearest the instrument strings. The adjustment means are substantially cylindrically symmetrical such as hexagonal inner axial bores adapted to adjustment by an allen wrench or such, or square, hexagonal or other geometric outer flats for engagement with a socket wrench. The axial bore with hexagonal flats for adjustment by an allen wrench is the preferred embodiment.

The unhardened pole pieces extend downward through the side of the bobbin. A pair of bar-type permanent magnets are disposed, one abutting each side of each cylindrical pole piece. The two bar-type permanent magnets each has the same polarity adjacent the set of cylindrical pole pieces. A keeper bar bridges the poles of the permanent magnets. Depressions in the underside of the bobbin provides position indexing of the permanent magnets.

A winding of many turns of insulated wire forms a coil on the bobbin which encloses all of the cylindrical pole pieces. When ferrometallic string vibrates adjacent to one of the pole pieces, the varying magnetic flux passing through the coil sets up a varying electrical signal in the coil.

Although such novel feature or features believed to be characteristic of the invention are pointed out in the claims, the invention and the manner in which it may be carried out, may be further understood by reference to the description following and the accompanying drawings.

FIG. 1 shows a simplified transverse cross sectional drawing of an embodiment of the invention.

FIG. 2 shows an exploded view in partial section of a practical embodiment of the invention.

FIG. 3 shows a bottom view of the bobbin.

FIG. 4 shows a cross section of an embodiment of the invention.

FIG. 5 shows a schematic diagram of a single magnetic pickup connected to an amplifier.

Referring now to the figures in greater detail, where like reference numbers denote like parts in the various figures.

A simplified version of the magnetic pickup of the present invention is shown generally at 10 in FIG. 1. An unhardened pole piece 12 has one of its ends 14 disposed in the vicinity of a ferromagnetic instrument string 16. First and second permanent bar magnets **18*a*, 18*b* have their respective south poles 20*a*, 20*b* abutting the end 22 of the pole piece 12 remote from the string 16. A keeper 24 bridges the respective south poles 20*a*, 20*b* of the permanent bar magnets 18*a*, 18*b***.

The permanent bar magnets **18*a*, 18*b*, keeper 24 and pole piece 12 set up a high and wide magnetic field 28 which includes the region occupied by the instrument string 16**.

A coil 30 of many turns of insulated wire encloses the pole piece 12. As the instrument string 16 vibrates in the magnetic field 28, the lines of flux passing through the pole piece 12, and consequently the lines of flux enclosed by the coil 30, varies at the frequency of vibration of the instrument string 16.

An axial bore 32 in the end 14 of the pole piece 12 is provided with flats (not shown) as for engagement with an allen wrench. The axial bore 32 is axially symmetrical in order that the magnetic field 28 is independent of the rotational orientation of the pole piece 12.

The bar magnets 18*a*, 18*b* may be rotated 180 degrees such that the south poles 20*a*, 20*b* face each other on opposite sides of the end 22 of the pole piece 12 without departing from the spirit and scope of the invention. However, the orientation of the poles as shown in FIG. 1 is the preferred embodiment. In addition, the proper functioning of the pickup is indifferent to inversion of the bar magnets 18*a*, 18*b*, whereby the north poles 26*a*, 26*b* are adjacent the end 22 and the keeper 24 is retained against the south poles 20*a*, 20*b*. In a dual pickup embodiment to be explained later, both orientations of bar magnet poles are used.

Referring now to a practical embodiment of the invention shown in the exploded view in FIG. 2, a bobbin 34 of non-magnetic material, preferably molded plastic, contains a plurality of parallel bores 36*a*–36*f* completely through a central web 38. The bores 36*a*–36*f* are undersized for the outside diameter of the pole pieces 12*a*–12*f* respectively. Thus, the threads on the pole pieces 12*a*–12*f* cut matching threads into the relatively soft material of the parallel bores 36*a*–36*f* when the pole pieces 12*a*–12*f* are initially screwed in place. Alternatively, threads may be molded or separately cut in the parallel bores 36*a*–36*f* rather than depending on the threadable insertion of the pole pieces to cut them.

The pole pieces 12*a*–12*f* extend downward past the bobbin 34 between the parallel bar magnets 18*a*, 18*b*. The pole pieces 12*a*–12*f* may be individually adjusted upward or downward to be closer to, or further away from their respective strings (not shown). For example, pole piece 12*b* is shown extended further upward than its neighboring pole pieces 12*a* and 12*c*. During the rotation of the pole pieces 12*a*–12*f*, the flux path through the pole pieces 12*a*–12*f* is independent of the rotational position of the pole pieces 12*a*–12*f* in contrast to the slot-headed adjustment screws found in the prior art which exhibit peaks and valleys of transducer output every 90 degrees of rotation of the slot.

An upper ledge 40 extends outward normal to the central web 38 at the upper end thereof, forming a rim to retain one side of the coil 30 shown in dashed outline in FIG. 2 to allow other details to be seen. A lower ledge 42 extends outward normal to the central web 38 at the lower end thereof, thereby forming a rim to retain the other side of the coil 30. The lower ledge 42 may have ears 44*a*, 44*b* extending integrally therefrom with attachment holes 46*a*, 46*b* therein, for attachment of the magnetic pickup 10 to the instrument (not shown) on which it is installed.

Referring now to the underside view of the bobbin 34, first and second rectangular pockets 48*a*, 48*b* are molded or otherwise formed in the bottom surface 50 of the bobbin 34. The pockets 48*a*, 48*b* are located immediately adjacent bores 36*a*–36*f*. The bar magnets 18*a*, 18*b* are indexed into the pockets 48*b*, 48*a* and retained therein using any suitable means such as glue. Thus, the bar magnets 18*a*, 18*b* are accurately positioned in abutting relationship with the pole pieces 12*a*–12*f* when they are installed in the parallel bores 36*a*–36*f*.

The bobbin 34 may optionally be formed with a stabilizing lip 52 integrally formed with the lower ledge 42. An attachment hole 46*c* may be located in the stablizing lip 52. Other holes 54*a*, 54*b* may be provided through the bobbin 34 for feeding signal wires (not shown) therethrough or for other purposes.

Returning now to FIG. 2, it is desirable that the bar magnets 18*a*, 18*b* be as close as possible to the pole pieces 12*a*–12*f*. It is within the contemplation of the present disclosure that the bar magnets 18*a*, 18*b* may be in physical contact with the pole pieces 12*a*–12*f* or with the keeper, or they may be separated by an air gap. The bar magnets 18*a*, 18*b* may be in such close proximity that the pole pieces 12*a*–12*f* may cut partial thread-like grooves in the facing edges thereof. The thread-like grooves, which may be separately formed prior to assembly of the magnetic pickup 10, may be used for retention and threadable adjustment of the pole pieces 12*a*–12*f*, either alone, or in combination with the thread-like grooves previously described in the parallel bores 36*a*–36*f*.

A hollow cover 56 of non-magnetic material, preferably molded plastic, has a cap 58 which fits over, and accommodates within it, the upper ledge 40 and the coil 30. A pair of tabs 60*a*, 60*b* project normally outward from the lower edge of the cap 58. A pair of holes 62*a*, 62*b* are located in registration with the attachment holes 44*a*, 44*b* as indicated by the dashed lines passing therethrough.

A plurality of access openings 64*a*–64*f* in registration with pole pieces 12*a*–12*f* respectively allow access to the axial bores 32*a*–32*f* respectively for height adjustment of the pole pieces 12*a*–12*f*. The access openings 64*a*–64*f* may be large enough to permit the upper ends of the pole pieces 12*a*–12*f* to project therethrough, or alternatively, the pole pieces 12*a*–12*f* may remain within the cap 58.

An alternative way of affixing the pole pieces is shown in FIG. 4. The keeper 24 contains a plurality of bored and tapped holes 74 in registration with the pole pieces 12. The pole pieces 12 are threadably engaged in the tapped holes 74. The permanent bar magnets 18*a*, 18*b* are in abutment with the sides of the keeper 24. This is the preferred embodiment.

Referring now to the schematic diagram of FIG. 5, the output of a single magnetic pickup 10 adjacent to ferromagnetic strings 16 (only one string 16 is shown) as previously described, is connected across volume control variable resistor R1 to ground. The signal at the wiper of volume control variable resistor R1 is connected through audio cable 68 and jack J1 to an audio amplifier 70 of a type well known in the art. The audio amplifier 70 amplifies the input signal to room-filling amplitude when connected to a suitable speaker 72. A tone control variable resistor R2 feeds a selected portion of the signal to shunt capacitor C1. Shunt capacitor C1 preferentially shunts a selectable portion of the high frequency components in the signal to ground depending on the setting of tone control variable resistor R2.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A magnetic pickup for a stringed musical instrument employing a plurality of metallic strings comprising:

(a) a plurality of unhardened cylindrical ferrometallic pole pieces at least equal in number to the number of said metallic strings;
(b) said pole pieces being externally threaded;
(c) non-metallic holding means for holding a first end of each said pole pieces adjacent said strings;
(d) a winding of a plurality of turns of insulated wire on said means for holding, said winding enclosing all of said pole pieces;
(e) cylindrically symmetrical adjustment means in the first ends of said pole pieces;
(f) the second ends said pole pieces extending outward from said means for holding;
(g) first and second spaced apart bar magnets disposed on either side of said second ends;
(h) like polarities of said first and second bar magnets facing said second ends of said pole pieces;
(i) a ferrometallic keeper touching and bridging said spaced apart bar magnets; and
(j) threaded means in at least one of said means for holding, first and second bar magnets and keeper for threadable longitudinal adjustment of said pole pieces with respect to said strings by rotation thereof.

2. The apparatus recited in claim 1 wherein said holding means comprises:

(a) a plastic bobbin;
(b) said plastic bobbin having a web containing a plurality of parallel aligned bores passing completely therethrough adapted to containing said pole pieces; and
(c) upper and lower ledges at the extremities of said web adapted to containing the ends of said winding.

3. The apparatus recited in claim 2, further comprising first and second depressions in the outer surface of said lower ledge, said first and second depressions being adapted to fit the abutting surfaces of said first and second bar magnets and provide position reference thereto.

4. The apparatus recited in claim 1 wherein said threaded means comprises threads in said means for holding.

5. The apparatus recited in claim 1 wherein said threaded means comprises threads in the facing surfaces of said first and second bar magnets.

6. The apparatus recited in claim 1 wherein said threaded means comprises a plurality of threaded holes in said keeper adapted to threaded engagement with the external threads on said pole pieces.

7. The apparatus recited in claim 1 wherein said adjustment means comprises:

(a) a generally cylindrical axial bore in the first end of each of said pole pieces; and
(b) adjustment flats in the perimeter of each axial bore.

8. The apparatus recited in claim 1 further comprising:

(a) a cap;
(b) said cap being adapted to enclose said holding means and said winding; and
(c) a plurality of holes in said cap aligned with said pole pieces to permit the protrusion therethrough of said pole pieces.

9. A magnetic pickup for a stringed musical instrument employing a plurality of metallic strings comprising:

(a) a plastic bobbin;
(b) said plastic bobbin containing a plurality of parallel bores completely therethrough, the axes of each of said parallel bores being aligned with, and normal to, one of said plurality of metallic strings;
(c) a plurality of cylindrical unhardened ferromagnetic pole pieces, one each in said parallel bores;
(d) said pole pieces having first and second ends, said first ends protruding outward from said parallel bores adjacent said strings and said second ends protruding outward from said parallel bores on the opposite side of said bobbin;
(e) first and second spaced-apart permanent bar magnets respectively adjacent said second ends;
(f) said first and second bar magnets having like poles facing all of said second ends;
(g) at least one winding of a plurality of turns of wire on said bobbin, each turn of said winding enclosing all of said pole pieces;
(h) a keeper of ferromagnetic material touching and bridging said first and second bar magnets;
(i) threaded means for individual longitudinal adjustment of said pole pieces toward and away from said strings; and
(j) axial holes having regular polygonal cross section in the first ends of said pole pieces.

10. The apparatus recited in claim 9 further comprising first and second depressions in said opposite side for registered assembly of said first and second bar magnets partially thereinto.

* * * * *